United States Patent [19]

Ebinuma et al.

[11] Patent Number: 4,610,202

[45] Date of Patent: Sep. 9, 1986

[54] INK RESERVOIR

[75] Inventors: Ryuichi Ebinuma, Hiratsuka; Yoshifumi Hattori, Yamato; Hiroo Ichihashi, Hiratsuka, all of Japan

[73] Assignee: Canon Kabushiki Kaisha, Tokyo, Japan

[21] Appl. No.: 684,120

[22] Filed: Dec. 20, 1984

[30] Foreign Application Priority Data

Dec. 26, 1983 [JP] Japan ..... 58-244137

[51] Int. Cl.[4] ..... B41F 31/02

[52] U.S. Cl. ..... 101/364; 346/140 R; 73/304 R; 116/109

[58] Field of Search ..... 101/364, 366, DIG. 24; 73/1 H, 304 C, 304 R; 361/284; 137/392; 33/1 V; 400/126; 346/140 R; 116/109, 227

[56] References Cited

U.S. PATENT DOCUMENTS 3,777,698 12/1973 Hunter ..... 116/109
3,880,005 4/1975 Butterfield et al. ..... 116/227 X
4,196,625 4/1980 Kern ..... 346/140 PD X
4,342,042 7/1982 Cruz-Uribe et al. ..... 346/140 R
4,470,008 9/1984 Kato ..... 73/304 C X

FOREIGN PATENT DOCUMENTS 65854 5/1969 German Democratic Rep. ... 73/304 R
1359161 7/1974 United Kingdom ..... 73/1 H

*Primary Examiner*—Edgar S. Burr
*Assistant Examiner*—John A. Weresh
*Attorney, Agent, or Firm*—Fitzpatrick, Cella, Harper & Scinto

[57] ABSTRACT

An ink jet recorder comprises a first tank as an ink supply source, a second tank as an ink supply source for the first tank, and three switching means and a pump arranged in an ink supply path. By controlling open/-close states of the switching means and operation condition of the pump, print mode, supply mode, pressure mode, circulation mode or store mode can be selectively established.

10 Claims, 4 Drawing Figures

INK RESERVOIR

BACKGROUND OF THE INVENTION

1. Field of the Invention

The present invention relates to an ink reservoir, and more particularly to an ink reservoir having an ink level sensor for detecting the amount of ink stored in an ink supply tank which serves as an ink supply source to a print head.

2. Description of the Prior Art

In a prior art ink reservoir, portions of top and bottom sides of the ink supply tank are recessed to form a pair of recesses arranged so as to be horizontal relative to the ink level, a pair of sensors such as electrodes are arranged on the recesses, so that the sensors are disposed to be substantially parallel to the ink level (i.e., horizontal), and the ink level is detected by a change of the electrostatic capacitance between the electrodes.

However, in such an ink reservoir, when the ink remains on the inner sides of the recesses due to surface tension as the ink level lowers, or when the ink is deposited thereon as a result of vibration, the quantity of ink cannot be detected.

SUMMARY OF THE INVENTION

It is an object of the present invention to provide an ink reservoir in which a sensor is arranged obliquely, or preferably perpendicularly to the ink level so that the quantity of the ink can be exactly detected.

It is another object of the present invention to provide an ink reservoir having a tank for storing ink to be supplied to a head, in which the tank has an area for communicating an ink reservoir area with an air chamber, and a sensor for detecting an ink level of the ink stored in the tank is arranged outside of the area with a sensing plane being inclined to the ink level.

DETAILED DESCRIPTION OF THE PREFERRED EMBODIMENTS

Figure 1:
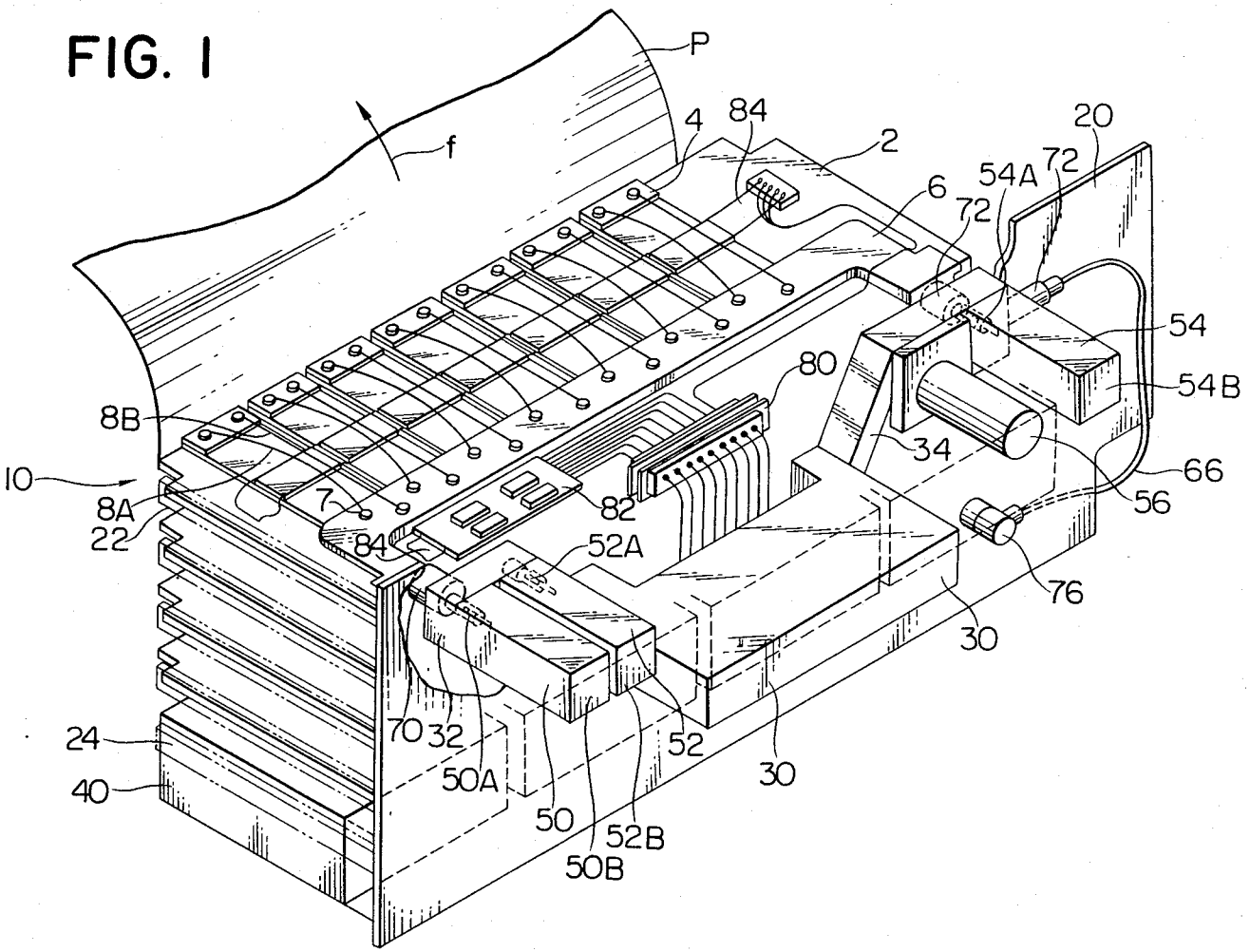
FIG. 1 is a perspective view of an ink jet recorder in accordance with the present invention.

FIG. 1 shows major elements of an ink jet recorder in accordance with the present invention. In the present embodiment, a four-color ink jet printer which has a plurality of print heads arranged widthwise of a record paper and prints on demand is used.

In FIG. 1, P denotes a record paper and an arrow f shows a feed direction of the record paper P. Numeral 2 denotes a unit plate. Seven head elements 4 are arranged on each of front and rear surfaces of the unit plate 2 across an entire width of the record area of the record paper P. Each head element 4 has 128 ink discharge orifices arranged widthwise to face the record paper P. Those head elements 4 are appropriately arranged on the both surfaces of the unit plate 2 such that the record areas by the discharge orifices of the head elements 4 arranged on the front side of the unit plate 2 and the record areas by the discharge orifices of the head elements 4 arranged on the rear side of the unit plate 2 do not overlap on each other and attain one line of print. In the record operation, the head elements on the rear side are first driven, and when the recorded area comes to face the head elements on the front side as the record paper P is moved in the direction f, the head elements on the front side are driven so that one line is printed.

Numeral 6 denotes a distributor which comprises a forward path distributor 6A for supplying ink to the head elements 4 through a supply tube 8A and a return path distributor 6B for recovering ink from the head elements 4 through a supply tube 8B. Numeral 7 denotes a joint (D-joint) which connects the distributor 6 with the supply tube 8. Those elements constitute a head unit 10 for one color of the ink. In the present embodiment, four such head units 10 are provided, one for each color of the ink.

Numeral 20 denotes a mother board, numeral 22 denotes a guide member which guides the unit plate 2 to mount the head unit 10 on the mother board, numeral 30 denotes a first tank as an ink supply source to the head elements 4. It stores the ink and is arranged on the opposite side of the mother board 20 to the head unit 10. Numeral 40 denotes a second tank as an ink cartridge tank. It is guided by the guide member 24 on the mother board 20 when it is mounted on the mother board 20. The first tank 30 has a liquid level sensor, and when the liquid level sensor detects that the quantity of ink in the first tank 30 is below a predetermined quantity, the ink is supplied from the second tank 40 to the first tank 30. Numerals 32 and 34 denote arms of the first tank 30. Switching means 50 and 52 such as solenoid valves are arranged on the arm 32 and switching means 54 such as a solenoid valve and a pump 56 are arranged on the arm 34. The switching means 50, 52 and 54 may be stops or gate valves instead of the solenoid valves.

The solenoid valve 50 has a valve 50A which connects a tube path 60 extending to the ink reservoir in the first tank on the arm 32 with a joint (D-V joint) 70 leading to the distributor 6A through the mother board 20. The valve 50A is opened as a solenoid 50B is energized so that an ink flow path is established. The solenoid valve 52 has a valve 52A which connect an air chamber within the first tank 30 with an external atmosphere. The valve 52A is opened as a solenoid 52B is energized to open the air chamber in the first tank 30 to the atmosphere. A dust filter 53 may be arranged on the atmosphere side of the valve 52A.

The solenoid valve 54 is formed on the arm 34 and has a valve 54A which connects a joint 72, which connects a tube path 64 extending to the pump 56 with a tube path 66 extending to the second tank 40, with a D-V joint 74 which extends through the mother board to the distributor 6B. The valve 54A is opened as a solenoid 54B is energized to establish an ink flow path between the pump 56 and the distributor 6B. Numeral 76 denotes a joint (T-C joint) which connects the tube 66 with the second tank 40.

The pump 56 is connected to the second tank through the tube path 64 extending to the valve 54, the tube path 68 extending to the first tank 30 and backflow prevention means such as a check valve, and supplies the ink from the second tank 40 to the first tank 30 through the valve 54A or supplies the ink to the valve 54A depending on the forward or backward operation of the pump 56.

The elements 30, 40, 50, 52, 54 and 56 constitute an ink supply stage for the head unit 10. In the recorder of FIG. 1, four such stages are provided, one for each color of the ink, although only one stage is shown in FIG. 1 to avoid complexity of explanation. The ink supply stage is connected to the head unit 10 through the D-V joints 70 and 74. This connection will be explained later.

Numeral 80 denotes a connector to a control unit not shown and it is mounted on the mother board 20. Numeral 82 denotes an interface board and numeral 84 denotes a flexible wiring board for transmitting a print control signal supplied from the control unit through the connector 80 and the interface board 82, to the head elements 4.

In the ink jet printer of the present invention, since the head unit, the ink supply stage and the electrical wiring are constructed on and around the mother board, the removal of each unit is easy.

The liquid level meter for the first tank 30 is now explained.

Figure 2:
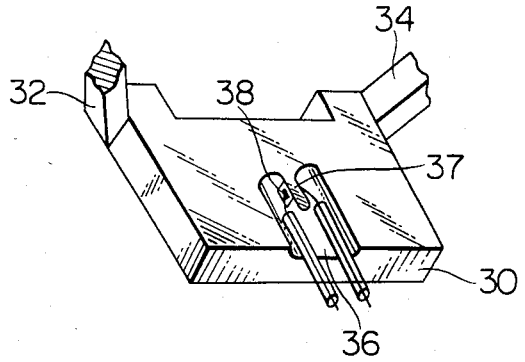
FIG. 2 is a perspective view of a liquid level meter in the ink jet recorder of FIG. 1, and FIGS. 3A and 3B are plan view and sectional view, respectively.
Figure 3A:
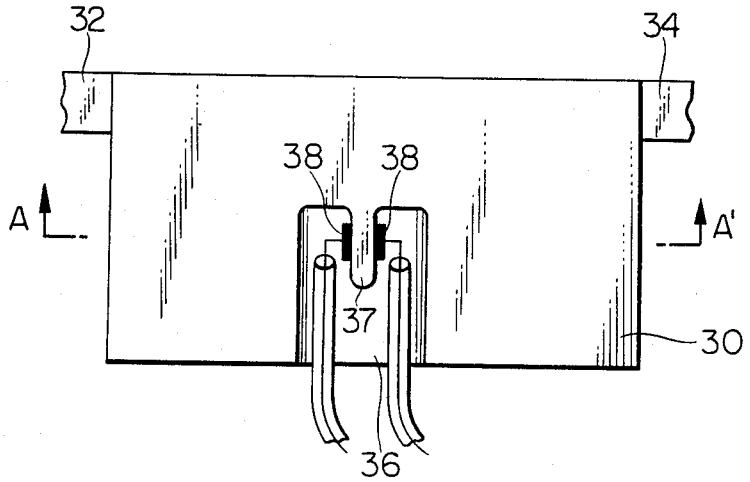
Figure 3B:
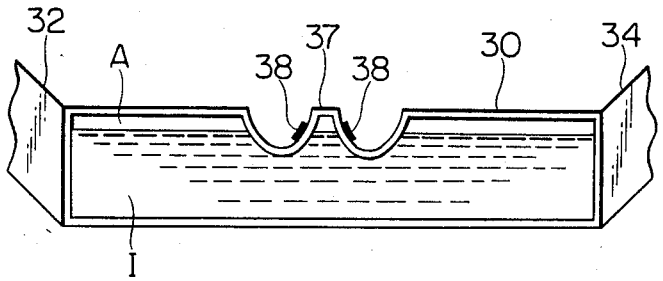

FIG. 2 shows an embodiment of the first tank 30 having the liquid level sensor, FIG. 3A shows a plan view thereof and FIG. 3B shows a sectional view taken along a line A—A' in FIG. 3A. In the present embodiment, the first tank 30 has a recess 36 and a projection 37 rising from the recess. As shown in FIG. 3B, the bottom of the projection 37 is gradually widened and contacts to the ink reservoir I. A pair of sensors, for example, electrodes 38 are arranged to face each other on the outer walls of the projection. By detecting an electrostatic capacitance between the electrodes, a level of the ink in the first tank 30 or the presence or absence of the ink is detected. When the projection 37 is made of a transparent material, the sensor may be a photocoupler.

As shown in FIG. 3A, the recess 36 and the projection 37 are preferably formed such that the sensors are arranged at the center of the first tank 30.

In the liquid level meter of the present embodiment, the projection 37 is formed in the first tank and the sensors are arranged on the outer walls of the projection substantially perpendicularly to the ink level. Accordingly, when the ink decreases or it is vibrated, the ink does not deposit on the inner wall of the projection and the liquid level can be precisely detected. Since the bottom of the projection spreads as shown in FIG. 3B, the rise of the liquid level on the inner walls of the projection due to surface tension is prevented and the accuracy of the liquid level detection is further improved. Since the sensors are located at the center of the tank, a correct liquid level can be detected even when the tank is slightly inclined.

As explained above, in the present invention, since portion on which the sensor is arranged is formed to be substantially perpendicular to the ink level, the liquid level of the ink can be precisely and surely detected.

Further, in the above embodiment, since the inner surface of the portion on which the sensor should be arranged is formed so as to spreads toward the liquid level, the rise of the liquid level due to surface tension is prevented so that the accuracy of the liquid level detection is further improved. Additionally, since the sensor are located at the center of the tank, it is possible to prevent error detection of a liquid level even when the tank is inclined.

We claim:

1. An ink reservoir for storing ink to be supplied to a print head, said ink reservoir comprising:

a tank for storing ink to be supplied to the print head;

an ink level measurement area in said tank; and a sensor for detecting the ink level of the ink stored in said tank, said sensor being arranged outside of said ink level measurement area said tank has a top surface, and wherein a portion of said top surface of said tank has a recess defined therein and a projection is defined rising from said recess, said projection defining said ink level measurement area, and said tank has a bottom and wherein said ink level measurement area becomes wider toward said bottom of said tank.

2. An ink reservoir according to claim 1 wherein said ink level measurement area is disposed at the center of said top surface of said tank.

3. An ink reservoir according to claim 1 wherein said sensor comprises a pair of electrodes and the ink level is detected by means of an electrostatic capacitance between said electrodes.

4. An ink reservoir according to claim 1 wherein said ink level measurement area is made of transparent material and said sensor comprises a pair of photocouplers so that the ink level is detected by the transmission of light.

5. An ink reservoir according to claim 1 wherein said ink level measurement area is disposed at the center of said top surface of said tank.

6. An ink reservoir according to claim 1 wherein said sensor comprises a pair of electrodes and the ink level is detected by means of an electrostatic capacitance between said electrodes.

7. An ink reservoir according to claim 1 wherein said ink level measurement area is made of tansparent material and said sensor comprises a pair of photocouplers so that the ink level is detected by the transmission of light.

8. An ink reservoir according to claim 1 wherein said ink level measurement area is disposed at the center of said top surface of said tank.

9. An ink reservoir according to claim 1 wherein said sensor comprises a pair of electrodes and the ink level is detected by means of an electrostatic capacitance between said electrodes.

10. An ink reservoir according to claim 1 wherein said ink level measurement area is made of transparent material and said sensor comprises a pair of photocouplers so that the ink level is detected by the transmission of light.

* * * * *

UNITED STATES PATENT AND TRADEMARK OFFICE

CERTIFICATE OF CORRECTION

PATENT NO. : 4,610,202

DATED : September 9, 1986

INVENTOR(S) : RYUICHI EBINUMA, ET AL.

It is certified that error appears in the above-identified patent and that said Letters Patent is hereby corrected as shown below:

Column 1, line 29, after "perpendicularly" insert --,--.

Column 1, line 44, after "are" insert --a--.

Column 1, line 44, after "and" insert --a--.

Column 1, line 57, change "each of" to --the--.

Column 1, line 58, change "an" to --the--.

Column 1, line 67, delete "on".

Column 1, line 67, change "attain" to --provide--.

Column 2, line 12, change "tube 8" to --tubes 8A and 8B--.

Column 2, line 13, delete "the" (first occurrence).

Column 2, line 15, delete "the".

Column 2, line 41, change "connect" to --connects--.

Column 2, line 42, change "an" to --the--.

Column 3, line 1, delete "the".

Column 3, line 6, change "not" to --(not--.

Column 3, line 7, change "shown" to --shown)--;
change "and it" to --the connector 80--.

Column 3, line 26, delete "to".

Column 3, line 28, change "an" to --the--.

Column 3, line 29, change "a" to --the--.

Column 3, line 30, delete "the" (third occurrence).

Column 3, line 40, after "ink" insert --supply-- and change "it" to --the ink--.

UNITED STATES PATENT AND TRADEMARK OFFICE

CERTIFICATE OF CORRECTION

PATENT NO. : 4,610,202

DATED : September 9, 1986

INVENTOR(S) : RYUICHI EBINUMA, ET AL.

It is certified that error appears in the above-identified patent and that said Letters Patent is hereby corrected as shown below:

Column 3, line 41, change "does" to --is-- and change "deposit" to --deposited--.

Column 3, line 48, change "a" to --the--.

Column 3, line 50, after "since" insert --the--.

Column 3, line 56, change "spreads" to --spread--.

Column 4, line 4, change "are" to --is--.

Column 4, line 5, change "error" to --erroneous-- and "a" to --the--.

Column 4, line 14, after "area" insert --; wherein--.

Signed and Sealed this

Twenty-fourth Day of February, 1987

*Attest:*

DONALD J. QUIGG

*Attesting Officer* *Commissioner of Patents and Trademarks*